US009145759B2

(12) United States Patent
Webb et al.

(10) Patent No.: US 9,145,759 B2
(45) Date of Patent: Sep. 29, 2015

(54) CAPTURE BASKET SYSTEM FOR AN UNDERDECK PIPEHANDLING MACHINE

(75) Inventors: Jonathan Garrick Webb, Kristiansand (NO); Froystein Hustadnes, Kristiansand (NO)

(73) Assignee: National Oilwell Varco Norway AS (NO)

( * ) Notice: Subject to any disclaimer, the term of this patent is extended or adjusted under 35 U.S.C. 154(b) by 136 days.

(21) Appl. No.: 13/878,746

(22) PCT Filed: Oct. 11, 2011

(86) PCT No.: PCT/NO2011/000289

§ 371 (c)(1), (2), (4) Date: Apr. 25, 2013

(87) PCT Pub. No.: WO2012/050458

PCT Pub. Date: Apr. 19, 2012

(65) Prior Publication Data

US 2013/0206388 A1 Aug. 15, 2013

(30) Foreign Application Priority Data

Oct. 12, 2010 (NO) ..... 20101410

(51) Int. Cl.
*E21B 40/00* (2006.01)
*E21B 41/00* (2006.01)

(52) U.S. Cl.
CPC ..... *E21B 40/00* (2013.01); *E21B 41/0021* (2013.01)

(58) Field of Classification Search
CPC ..... E21B 15/00; E21B 40/00; E21B 41/0021; E04G 21/14; E04G 21/3261
See application file for complete search history.

(56) References Cited

U.S. PATENT DOCUMENTS

| | | | | | |
|---|---|---|---|---|---|
| 2,123,268 | A * | 7/1938 | Young | 182/139 |
| 2,728,164 | A * | 12/1955 | Mears | 43/105 |
| 3,512,657 | A * | 5/1970 | Chambers | 414/138.3 |
| 3,527,319 | A * | 9/1970 | Pedley | 182/139 |
| 4,025,055 | A * | 5/1977 | Strolenberg | 254/277 |
| 4,982,813 | A * | 1/1991 | Starr | 182/138 |
| 5,167,277 | A * | 12/1992 | Evans | 166/81.1 |
| 5,167,299 | A | 12/1992 | Nusbaum | |
| 5,343,943 | A * | 9/1994 | Norris et al. | 166/81.1 |
| 5,429,206 | A * | 7/1995 | Nusbaum | 182/138 |
| 5,961,099 | A * | 10/1999 | Thommen, Jr. | 256/12.5 |
| 6,024,383 | A | 2/2000 | Fohl | |
| 6,666,287 | B2 * | 12/2003 | Holtby | 175/209 |
| 6,857,483 | B1 * | 2/2005 | Dirks et al. | 175/52 |
| 7,188,825 | B2 * | 3/2007 | Sennhauser | 256/12.5 |
| 2005/0148251 | A1 * | 7/2005 | Robit | 442/6 |

(Continued)

FOREIGN PATENT DOCUMENTS

| | | |
|---|---|---|
| DE | 19648675 A | 5/1998 |
| GB | 2011019 A | 7/1979 |

OTHER PUBLICATIONS

PCT/NO2011/000289 International Search Report and Written Opinion dated Jan. 11, 2012 (5 p.).

*Primary Examiner* — Jennifer H Gay
(74) *Attorney, Agent, or Firm* — Conley Rose, P.C.

(57) ABSTRACT

A capture basket system for use below an underdeck pipe-handling machine on a drill rig. The capture basket system includes a capture basket to retain a falling object such as a pipe. The capture basket is coupled to a structure of the drill rig by an energy absorber that includes an elongated element.

20 Claims, 3 Drawing Sheets

(56) References Cited

U.S. PATENT DOCUMENTS

2005/0205853 A1* 9/2005 Pan ..... 256/12.5
2007/0125613 A1* 6/2007 Fresno ..... 188/371
2008/0283303 A1 11/2008 Cote
2010/0327244 A1* 12/2010 Nishita et al. ..... 256/21
2013/0020096 A1* 1/2013 DeRouen, Sr. ..... 166/382
2013/0112479 A1* 5/2013 O'Blenes ..... 175/40
2013/0206388 A1* 8/2013 Webb et al. ..... 166/75.11
2013/0206478 A1* 8/2013 Selzer et al. ..... 175/52

* cited by examiner

CAPTURE BASKET SYSTEM FOR AN UNDERDECK PIPEHANDLING MACHINE

CROSS-REFERENCE TO RELATED APPLICATIONS

This application is the US. National Stage filing made under 35 U.S.C. §371 of International Application No, PCT/NO2011/000289 filed Oct. 11, 2011, which claims priority to Norwegian Patent Application No. 20101410 filed Oct. 12, 2010, entitled "A Capture Basket System For An Underdeck Pipehandling Machine."

STATEMENT REGARDING FEDERALLY SPONSORED RESEARCH OR DEVELOPMENT

Not applicable.

BACKGROUND

The present disclosure relates to a capture basket system for an underdeck pipehandling machine. More precisely, the present disclosure relates to a capture basket system for use below an underdeck pipehandling machine on a drill rig, where the capture basket system includes a capture basket that is designed to retain a falling object such as a pipe.

An "underdeck pipehandling machine" refers to machines positioned in and below a drill deck on drill rig such as a single or multi hole mousehole or an in-deck tong.

When handling pipes in an underdeck pipehandling machine, experience shows that a danger of dropping pipes during operation exists.

A pipe or stand dropped into a mousehole or by an underdeck handling device has the potential to cause significant damage to life or property. If the dropped object is able to fall into the ocean it also has the potential to cause catastrophic damage to well head equipment.

Mouseholes are sometimes provided, with an internal energy absorbing system which is sized to handle dropped pipes/stands. Due to the high kinetic energy involved, these devices are generally for once-only use.

In the case of an internal or integrated energy absorbing system, this force would normally be transferred, to the deck or other supporting structure via the structure of the mousehole/pipe handling device. In this case, the accidentally dropped object loading would become a load case for the structural design of the mousehole/pipe handling device.

This is not an optimum situation because the accidental load may be greater than the normal operating load cases.

Designing the mousehole/pipe handling device to withstand these loads, even assuming that the elastic limits are exceeded, may be extremely difficult and may result in weight/cost penalties.

The deceleration distance is of paramount importance in the design of any energy absorbing system. The longer the deceleration distance, the lower the force applied.

Therefore, from the point of view of structural design, a "long" energy absorbing system would generally be preferable to a "short" system. However under deck devices are often in conflict with other equipment/operations such as blowout preventers (BOPs), Christmas tree handling, and the like.

This means that the structural requirements may often be incompatible with the physical layout requirements.

U.S. Pat. Nos. 3,527,319 and 4,982,813 explain safety and safety shock absorbing nets. However, these are not capable of retaining a killing pipe of the kind associated with drill rigs.

U.S. Pat. No. 6,024,383 discloses an energy absorbing means that includes an energy converter for use in vehicles where a tubular converter body is deformed. GB Patent No. 2,011,019 shows a kinetic energy absorber where a tube is permanently deformed by a movable carriage, U.S. Pat. No. 6,338,399 discloses an energy absorption device that includes a sleeve through which a bolt head is drawn.

SUMMARY

There is provided capture basket system for use below an underdeck pipehandling machine on a drill rig, where the capture basket system includes a capture basket that is designed to retain a falling object such as a pipe, wherein the capture basket is connected to a structure of the drill rig by means of an energy absorber that includes an elongated element.

The elongated element may be in the form of a wire, a rope, a chain or a tie rod.

The capture basket system is hung from suitably engineered lugs beneath the drill deck structure. The capture basket is to be positioned close to, but not in contact with the underside of the underdeck pipehandling machine.

The basket is to be aligned with the vertical axis of the underdeck pipehandling machine, and will be arranged to hang in the required position by gravity acting on the non-vertical support wires.

The capture basket system according to the present disclosure is intended, to remove the energy absorbing requirement from the underdeck pipehandling machine, thereby reducing cost, weight and physical size of this part of the overall system.

The dropped object loads will be absorbed by a structure supporting the underdeck pipehandling machine. However, the capture basket system will transfer these loads directly to the structure of the drill rig rather than via the underdeck pipehandling machine. The supporting structure will often be a drill deck supporting structure that is already dimensioned for very high operating loads such as slips, riser, gimbal/spider, stand set-back area, and the like. The operating loads for the supporting structure will, in many cases, exceed the accidental load case presented by the capture basket system. Hence, only relatively minor local structural arrangements are foreseen for the capture basket system interface points.

A multiple mousehole/pipe handling system would logically require multiple capture basket systems; one for each mousehole/pipe handler.

The capture basket system is thus not a part of the pipehandling underdeck machine and may therefore be positioned directly below the object that represents the dropped object risk. Only one capture basket system would be required even for a multiple/moveable pipehandling underdeck machine.

The elongated element in the form of the wire, the rope, the chain or the tie rod may have energy absorbing characteristics. So called "kinetic energy ropes" are well known from the vehicle recovery industry, while the chains may be designed for deformation, for example, by having one or more links that change geometry during deformation. The tie rod may also have deformable parts, for instance a zig-zag form that is designed to straighten out during deformation.

In general, the physical stretch characteristics of the elongated elements are used as primary means of retarding the dropped object.

The elongated element may be connected to an absorber having energy absorbing characteristics when additional energy absorption is required.

Examples of such absorbers are pull-through taper die systems as disclosed by U.S. Pat. No. 6,338,399, progressive breaking of multiple short, "weak link" wires, or mechanical- or fluid-type shock absorbing devices.

The capture basket includes a meshed wire net such as a loosely woven wire basket intended to catch the dropped object being a pipe or a string.

In order to distribute the impact loads, the inside of the basket may be lined with plate surface that may be held in shape by rod hoops. The capture basket may thus include a plate lined net. The plate surface may be formed from curved strips of flat bar welded together. The plates and the hoops may be made from steel or any other convenient material.

Since the capture basket is for once-only use, the surface is intended to deform under impact. The capture basket may generally be made as a plate construction.

The form of an upwardly facing opening of the capture basket may be adapted to catch a falling object from the actual underdeck pipehandling machine.

Floating rigs or drill ships will be subject to motions and accelerations. If used in such applications the capture basket system would therefore need to be restrained in some way. In a typical single mousehole system, the lower end of the mousehole would be partly within the capture basket. In this case movement of the capture basket would be restrained.

At least one steadying elongated element may be positioned diagonally relatively to the elongated element(s) and another elongated element could be used to stabilize the system if required.

In a sliding mousehole arrangement, the top of the capture basket would be slightly below the bottom of the mousehole system. In this case the mousehole system would slide in between the support wires, whilst the capture basket would remain on the pipe lifting axis.

A steadying wire, chain, rope or tie rod is connected between the capture basket system and the structure of the drill rig at a position lower than the capture basket, or if installed above a moonpool, a multiple guy wire arrangement could be used.

A base of the underdeck pipehandling machine may be arranged as an easily replaceable punch-out panel. Any dropped pipe or string will simply punch through the base without significant energy transfer to the structure.

In cases where a powered "rabbit" or elevator unit is used within the underdeck pipehandling machine, this will be arranged to break free of the lifting equipment and exit into the capture basket together with the dropped object.

Any mud drain valves and hosing may be accessible when the capture basket system is in position.

This capture basket system according to the present disclosure is both simple and occupies relatively little space.

In accordance with certain embodiments, the presently disclosed system may have a shorter vertical operating envelope than an energy absorber system that is integrated in the underdeck pipehandling machine. This, combined with the reduced overall height of the underdeck pipehandling machine, offers the potential to improve layout opportunities and flexibility.

The space beneath the capture basket would need to be kept clear of critical items and personnel during operations where there is a dropped object potential.

In cases where the underdeck pipehandling machine needs to be removed or moved to allow passage of equipment such as BOPs, Christmas trees and the like, the capture basket system could be swung/winched out of the way, or even disconnected and removed.

For pipe handler systems with an "open" form, that is not a tube-type structure, the upper end of the pipe/stand may be restrained from tipping out of the capture basket.

BRIEF DESCRIPTION OF THE DRAWINGS

Non-limiting examples of various embodiments of the present disclosure are described in the following and are depicted in the accompanying drawings, in which.

DETAILED DESCRIPTION

Figure 1:
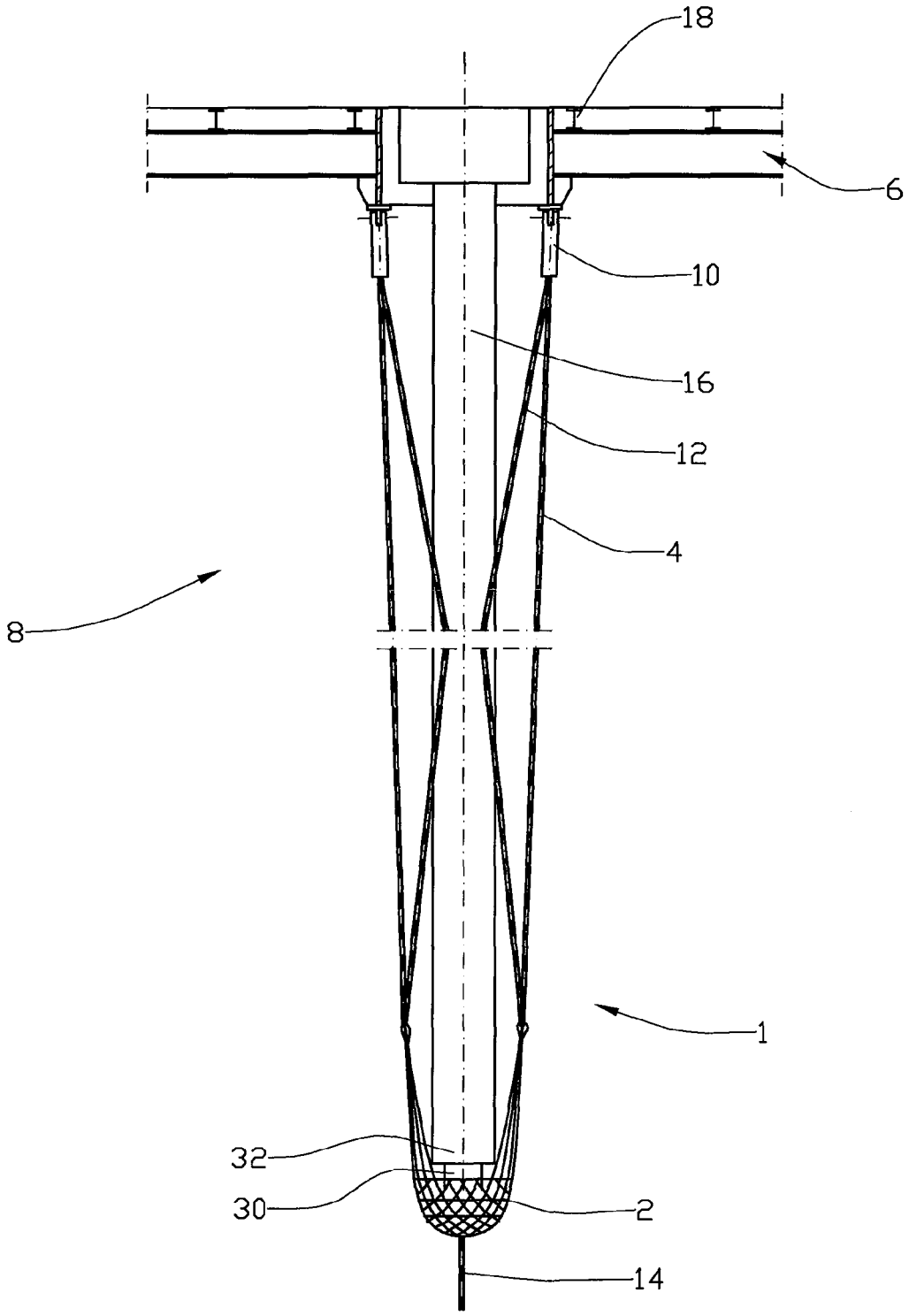
FIG. 1 shows a capture basket system in accordance with various embodiments of the present disclosure.

Referring to FIG. 1, reference number 1 denotes a capture basket system comprising a capture basket 2 and elongated elements 4 that extends from the capture basket 2 to a structure 6 of a drill rig 8 via energy absorbers 10. Although not shown in FIG. 1, one skilled in the art appreciates that at least some portions of the structure 6 of the drill rig 8 extend vertically below the capture basket 2.

Steadying elongated elements 12 are connected diagonally relative to the elongated elements 4. As an alternative, a steadying wire 14 may be stretched between the capture basket system 2 (shown here attached to the bottom of the capture basket 2) and the structure 6 at a position lower than the capture basket 2.

An underdeck pipehandling machine 16, here in the form of a movable mousehole, extends downwardly from drill deck 18 of the drill rig 8 to a position just above the capture basket 2.

The underdeck pipehandling machine 16 shown in FIG. 1 may thus be moved out of the capture basket 2 in the direction inwardly from the paper plane.

Figure 2:
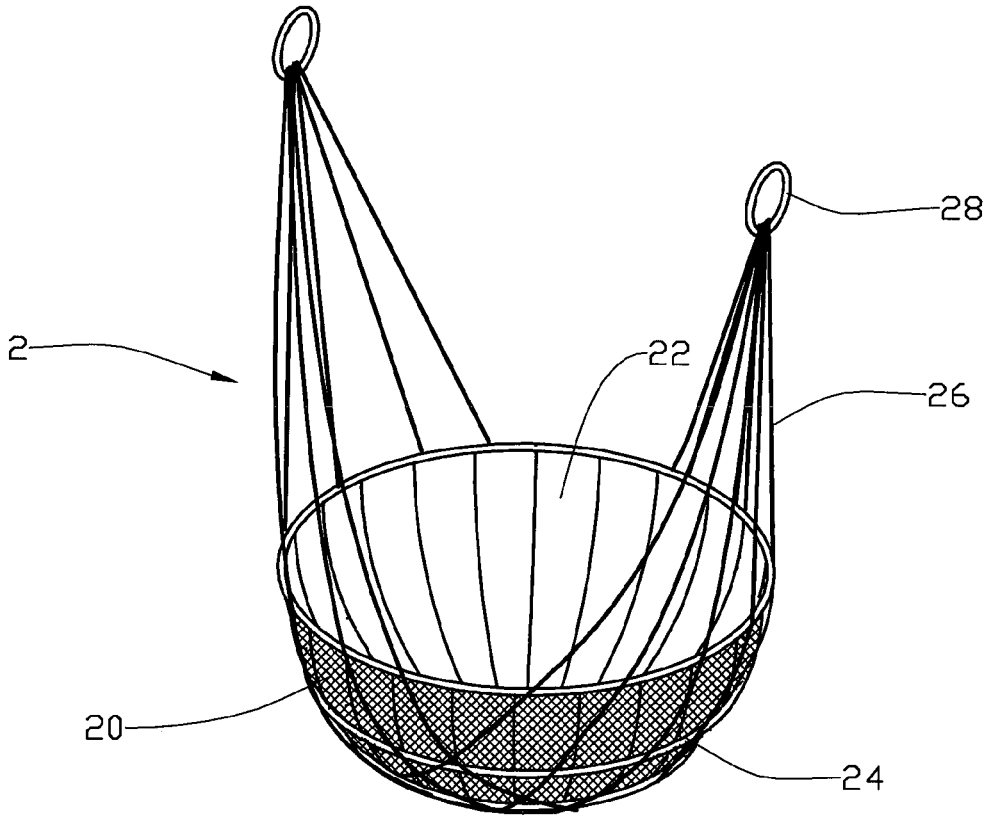
FIG. 2 shows a perspective view of a capture basket in accordance with various embodiments of the present disclosure.

The capture basket 2 in FIG. 2 includes a net 20 that is lined with plates 22 on its inner side. The net 20 is thus a reinforced net. The reinforced net 20 is held in shape by rod. hoops 24. Several load carrying wires 26 runs under the net 20 between two connectors 28 where the elongated elements 4, not shown in FIG. 2, are connected.

In the case where an object 30 in the form of a pipe or a pipe string is dropped from the underdeck pipehandling machine 16, the object 30 will penetrate a relatively weak plate, not shown, at the lower part 32 of the underdeck pipehandling machine 16.

The object 30 is retained by the capture basket 2. The resulting impact forces are transferred from the plates 22 and net 20 via the load carrying wires 26 and the connectors 28 to the elongated elements 4.

As the capture basket 2 is moved downwardly, the elongated elements 4 and absorbers 10 are stretched and, as a result, they absorb the impact energy from the object 30.

In some embodiments, the capture basket system 1 may be for one use only and will be replaced after an accidental dropped object event has occurred.

Figure 3:
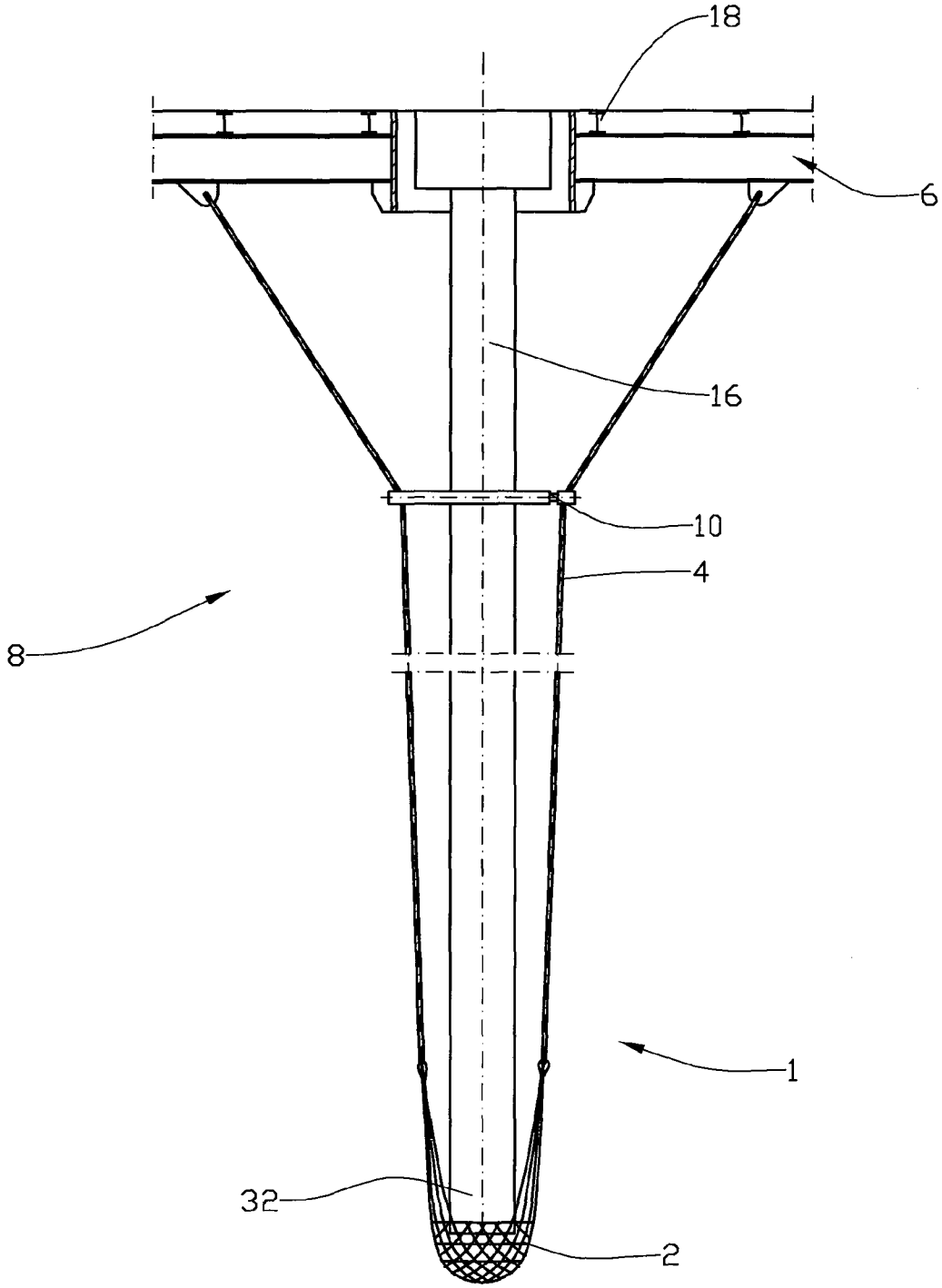
FIG. 3 shows an alternative embodiment of a capture basket system.

FIG. 3 shows an alternate embodiment where the underdeck pipehandling machine 16 is stationary. The lower part 32 of the underdeck pipehandling machine 16 extends into the capture basket 2 and is thus preventing the capture basket from any substantial sideways movement.

The energy absorber 10 of FIG. 3 is shown here as extending between the elongated elements 4.

The function of the capture basket system of FIG. 3 is otherwise similar to that explained above.

What is claimed is:

1. A capture basket system for use below an underdeck pipehandling machine on a drill rig, the capture basket system comprising:

a capture basket configured to catch and retain a falling object;

wherein the capture basket is coupled to a structure of the drill rig by an energy absorber that includes an elongated element; and wherein a lower end of the underdeck pipehandling machine extends at least partially into the capture basket.

2. The capture basket system according to claim 1 wherein the elongated element has energy absorbing characteristics.

3. The capture basket system according to claim 1 wherein the elongated element is connected to an absorber having energy-absorbing characteristics.

4. The capture basket system according to claim 3 wherein the absorber having energy-absorbing characteristics comprises a pull-through die system.

5. The capture basket system according to claim 3 wherein the absorber having energy-absorbing characteristics comprises a shock absorber.

6. The capture basket system according to claim 3 wherein the absorber having energy-absorbing characteristics comprises multiple weak link wires.

7. The capture basket system according to claim 3 wherein the capture basket comprises a wire net.

8. The capture basket system according to claim 7 wherein the capture basket comprises a plurality of plate members.

9. The capture basket system according to claim 8 further comprising at least one steadying elongated element extending at an acute angle relative to the elongated element of the energy absorber.

10. The capture basket system according to claim 1 wherein the capture basket comprises a meshed wire net.

11. The capture basket system according to claim 1 wherein the capture basket comprises a plate-lined net.

12. The capture basket system according to claim 1 wherein the capture basket includes a plurality of plate members.

13. The capture basket system according to claim 12 further comprising at least one rod hoop.

14. The capture basket system according to claim 1 wherein the capture basket comprises an upwardly facing opening configured to catch the falling object from the underdeck pipehandling machine.

15. The capture basket system according to claim 1 further comprising at least one steadying elongated element positioned diagonally relative to the elongated element.

16. The capture basket system according to claim 1 further comprising a steadying component to connect the capture basket system to the structure of the drill rig at a position lower than the capture basket.

17. The capture basket system according to claim 16 wherein the steadying component comprises one selected from the group consisting of: a wire, a chain, a rope, and a tie rod.

18. The capture basket system according to claim 1 further comprising at least one steadying elongated element extending at an acute angle relative to the elongated element of the energy absorber.

19. A capture basket system for use below an underdeck pipehandling machine on a drill rig, the capture basket system comprising:

a capture basket configured to catch and retain a falling object, the capture basket comprising a mesh element;

a plurality of elongate energy absorbing members coupled to the capture basket;

a plurality of energy absorbers, each of the plurality of energy absorbers being coupled to at least one of the elongate energy absorbing members and being adapted to be coupled to the drill rig; and a plurality of steadying elements coupled to the capture basket, each steadying element disposed so as to extend an acute angle relative to at least one of the elongate energy absorbing members;

wherein a lower end of the underdeck pipehandling machine extends at least partially into the capture basket.

20. The capture basket system according to claim 19 wherein the capture basket further comprises a plurality of plate members coupled to the mesh element.

* * * * *